US005201507A

United States Patent [19]

Tokuda

[11] Patent Number: 5,201,507

[45] Date of Patent: Apr. 13, 1993

[54] CASSETTE TYPE SHEET SUPPLYING DEVICE FOR USING A PLURALITY OF STANDARD CASSETTES OR A SINGLE LARGE CASSETTE

[75] Inventor: Hiroshi Tokuda, Nagoya, Japan

[73] Assignee: Brother Kogyo Kabushiki Kaisha, Nagoya, Japan

[21] Appl. No.: 828,189

[22] Filed: Jan. 30, 1992

[30] Foreign Application Priority Data

Mar. 27, 1991 [JP] Japan ..... 3-63288

[51] Int. Cl.[5] ..... B65H 3/44

[52] U.S. Cl. ..... 271/9; 271/117; 271/164

[58] Field of Search ..... 271/9, 117, 162, 164

[56] References Cited

U.S. PATENT DOCUMENTS

| | | | |
|---|---|---|---|
| 4,436,406 | 3/1984 | Murasaki | 271/164 X |
| 4,569,586 | 2/1986 | Koyama . | |
| 4,660,820 | 4/1987 | Shino | 271/162 X |
| 5,052,669 | 10/1991 | Ueda | 271/9 X |

*Primary Examiner*—Richard A. Schacher
*Attorney, Agent, or Firm*—Oliff & Berridge

[57] ABSTRACT

In a cassette type sheet supplying device, two or more adjoining spaces for installing standard cassettes therein are joined into a continuous space to enable a large cassette to be installed in the space in lieu of two stantard cassettes. When no cassette is installed or a standard cassette is installed, a paper feeding unit is pulled to the paper feeding position by a spring, and a claw portion of a lock material engages lock holes formed on paper feeding unit side frames so that the paper feeding unit is held to the paper feeding position. When the large cassette is inserted in the cassette installation space, a lock release projection formed on the large cassette comes in contact with a projection of the lock material and extends it to the outside. At this time, the claw portion comes off from the lock hole. When the large cassette is further inserted, the paper feeding unit is pushed through a cushion material. A paper feeding unit guide roller retreats to the retracted position being guided by a guide hole. According to the cassette type sheet supplying device thus constructed, a plurality of standard cassettes can be installed in a continuous space or one large cassette can be installed in the space in lieu of the standard cassettes.

19 Claims, 11 Drawing Sheets

CASSETTE TYPE SHEET SUPPLYING DEVICE FOR USING A PLURALITY OF STANDARD CASSETTES OR A SINGLE LARGE CASSETTE

BACKGROUND OF THE INVENTION

1. Field of the Invention

The present invention relates to a sheet supplying device for supplying cut sheets, which are cut to predetermined sizes, to printers, facsimile machines or copy machines one sheet at a time. Specifically, the present invention relates to a cassette-type sheet supplying device where a plurality of cassettes, each holding cut sheets of sized paper, such as B5, A4, B4 and A3, can be installed to supply the desired sized sheets during printing or copying.

2. Description of Related Art

One known type of a cassette sheet supplying device is capable of having two or more cassettes installed at the same time, the device feeding a cut sheet from one of the cassettes by selectively driving a paper feeding unit associated with each cassette. According to this sheet supplying device, the size of the cut sheet can be selected. Usually, the size of the cassettes is such that the cassettes can be interchanged for one another. Thus, each such cassette can be installed in an arbitrary cassette mounting position. Therefore, each cassette accommodates essentially the same number of cut sheets.

However, some users occasionally want to use large quantities of a sheet of one size, such as B5 or A4 sheets. In order to respond to such demand, a type of sheet supplying device that can receive a large cassette capable of accommodating large quantities of cut sheets has been developed.

FIG. 11 schematically shows this type of sheet supplying device. Interchangeable standard cassettes can be installed in installation spaces 50, 52 and a large cassette can be installed in installation space 54.

This type of sheet supplying device is very convenient for a user who, for instance, always requires large quantities of sheets of A4 size and sometimes uses sheets of B5 or B4 size. However, it is not always convenient for the user who always uses sheets of various sizes and sometimes requires large quantities of a sheet of a specific size. For such users, the large cassette is unnecessary when variously sized sheets are required, and standard cassettes are unnecessary when large quantities of a specific size are required. For such a user, it is only necessary to be able to install plural standard cassettes or one large cassette. The device for such a user permits the installation space, or the sheet supplying device, to be miniaturized because it is unnecessary to install both the plural standard cassettes and the large cassette at the same time. With such a device as mentioned above, it is unnecessary to have a paper feeding unit for feeding the cut sheets from each of the plural standard cassettes and the large cassette and a paper feeding path for feeding the cut sheets from each cassette to the predetermined position. Therefore, the structure required for the large cassette only can be omitted.

FIGS. 10A and 10B show a conventional sheet supplying device having a plurality of standard cassettes and a single large cassette. A standard cassette S1 is installed in an installation space 50 and a standard cassette S2 is installed in an installation space 52. A large cassette L is installed in an installation space 54. A paper feeding unit 26(S1), for the cassette installed in the installation space 50, and paper feeding units 26(S2), 26(L), for the cassettes installed in the installation spaces 52, 54, respectively, are provided as shown.

In the conventional sheet supplying device thus constructed, it is impossible to install the large cassette in the spaces 50, 52. Moreover, even if the large cassette L could fit into the space, by combining openings 50, 52, it cannot be sealed properly because proper positioning is obstructed by the paper feeding unit 26(S2).

SUMMARY OF THE PRESENT INVENTION

It is an object of the present invention to provide a sheet supplying device which is capable of alternatively installing a plurality of standard cassettes or one large cassette.

It is another object of the present invention to eliminate the requirement for a space only for holding the large cassette, thus enabling miniaturization of the sheet supplying device.

As shown in FIG. 8, in the present invention, two or more adjacent spaces, such as spaces 30, 32, for installing standard cassettes constitute a continuous space 34 into which a large cassette L can be installed. Moreover, the paper feeding unit support mechanism for retracting the paper feeding unit out of the continuous space 34 is linked with the installation of the large cassette L. The above paper feeding unit is for the cassette other than the uppermost cassette S1 which can be installed in the continuous space 34.

According to the sheet supplying device of the present invention, it is possible to install a plurality of standard cassettes S1, S2, or one large cassette L, in continuous space 34. Therefore, the sheet supplying device can supply the needs of the user who normally requires sheets of various sizes and occasionally requires large quantities of sheets of a specific size. According to this structure, it becomes unnecessary to have a space only for the large cassette by providing the paper feeding unit support mechanism, and it is therefore possible to miniaturize the sheet supplying device.

In the present invention, a plurality of standard cassettes can be installed or, alternatively, one large cassette can be installed instead of the standard cassettes. Therefore, it is not necessary to separately provide either an installation space or a paper feeding unit for the large cassette only. Thus, it is possible to use a large cassette without requiring a large-scale sheet supplying device. As a result, the large cassette can be installed in small and desktop types of copy and facsimile machines and printers, while satisfying the user's varying needs.

BRIEF DESCRIPTION OF THE DRAWINGS

The invention will be described in detail with reference to the following drawings, wherein.

DETAILED DESCRIPTION OF THE PREFERRED EMBODIMENTS

A preferred embodiment of the present invention will be described hereunder with reference to the accompanying drawings.

Figure 1:
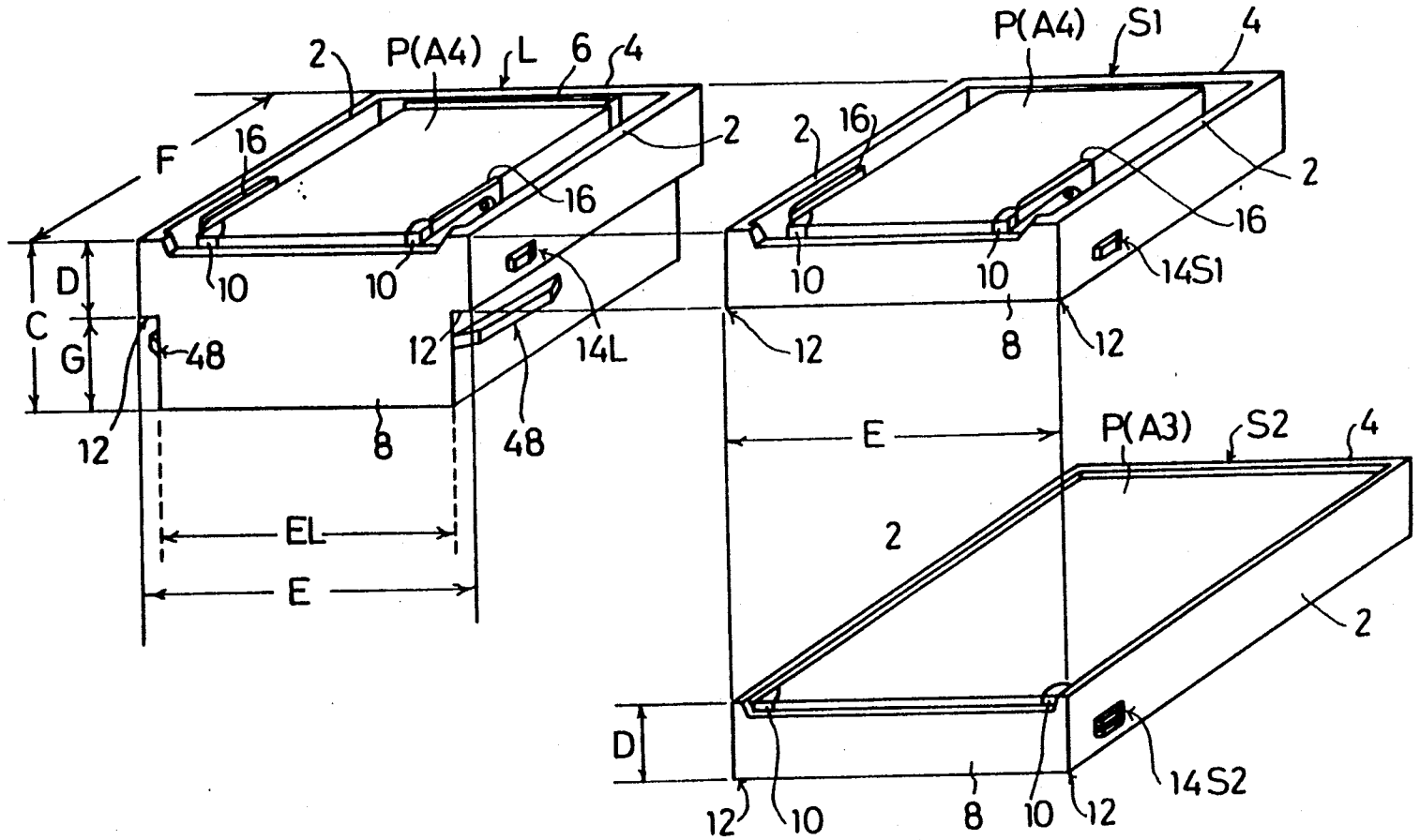
FIG. 1 is a perspective view showing various cassettes used for a sheet supplying device which embodies the present invention.

FIG. 1 is a perspective view showing various types of cassettes that can be used for the sheet supplying device of this embodiment. S1 is a standard cassette having a storage space of 15 mm thickness for holding sheet paper having lengths and widths smaller than that of the cassette, such as A4 paper P(A4). S2 is a standard cassette which also has a storage space of 15 mm thickness which can hold another sized cut sheet paper, such as A3 paper P(A3). For the standard cassettes S1, S2, the width E and the height D are equal, and either standard cassette can be installed in the same installation space. The length F of the standard cassette depends upon the sheet size. The change in length does not disturb installation interchangeability as the dimensions defining a standard cassette are its height and width.

Both a rear board 4 and a front board 8 of the standard cassette S2 correspond to the A3 size. The side boards 2,2 vary depending on the length of paper. The combination of side boards 2,2, rear board 4 and head board 8 associated with standard cassette S2 define a cassette for A3 paper. Further, paper side edge arrangement boards 16,16 are installed in t he cassette S1 for adjusting the width to hold paper of A4 size. Side boards 2,2 of cassette S1 are shorter than those of cassette S2. A pair of separation clicks 10,10 is provided in the cassette S1,S2. Each separation click 10 engages a corner of an uppermost cut sheet at the lead edge in the insertion direction of the cassette.

Moreover, projections 14S1, 14S2, having a different shape for each standard cassette based on the size paper it holds, are formed at the same position on the outer surface of one side board 2 of the cassette. The projections 14S1, 14S2 press switches 27U, 27L fixed to the side of sheet supplying device when the cassette is installed in the sheet supplying device (see FIG. 2). Each switch 27U, 27L provides a signal indicating whether a cassette is installed or not. Further, the projection/-switch combination identifies the type of cassette installed.

Figure 4:
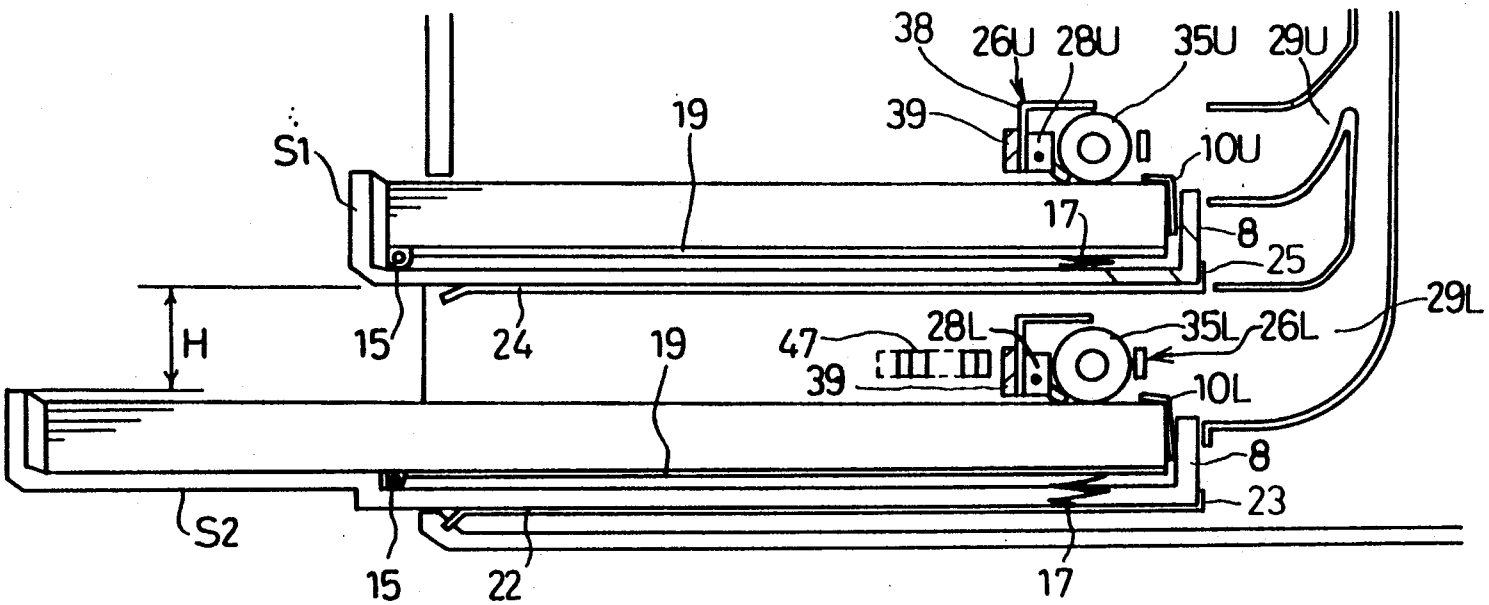
FIG. 4 is a side sectional view showing the sheet supplying device with standard cassettes installed.

As shown in FIG. 4, a hopper comprising a spring 17 and a bottom board 19, that is urged upwardly by the spring 17, is mounted in the bottom of each standard cassette S1,S2. Both corners of the leading edge of the uppermost sheet of the cut sheets held in the cassettes are engaged and retained by the separation clicks 10, as a result of the upward force exerted by the spring 17. The bottom board 19 rotates on a hinge 15.

As shown in FIG. 1, a large cassette L can hold a large amount of the A4 cut sheet paper P(A4). The width E and height D of the upper portion of the large cassette L are the same as that of the standard cassettes S1,S2. Further, a projection 14L, having a different shape from the projections on standard cassettes S1,S2, is provided in the same position as on a standard cassette. Although the width EL of the lower portion of the large cassette L is narrower than width E of the upper portion, it is sufficiently wide to accommodate the cut sheets of A4 paper P(A4). The height G of the lower portion of the large cassette L is greater than the height D of a standard cassette. That is, as shown in FIG. 4, if the space between the bottom of the standard cassette S1 and the top of the standard cassette S2 when installed in the sheet supplying device is assumed to be H, the height G of the lower part of the large cassette L becomes $G=D+H$. Therefore, in the large cassette L, the number of sheets that can be held in the holding space is more than the total number of sheets that can be held as a result of the height 2D of the two standard cassettes, such as S1, S2, because of additional space H.

Moreover, lock release projections 48 for extending lock materials 47 which will be described below are arranged around the intermediate part corresponding to the above space H in both lower sides of the large cassette L.

Figure 5:
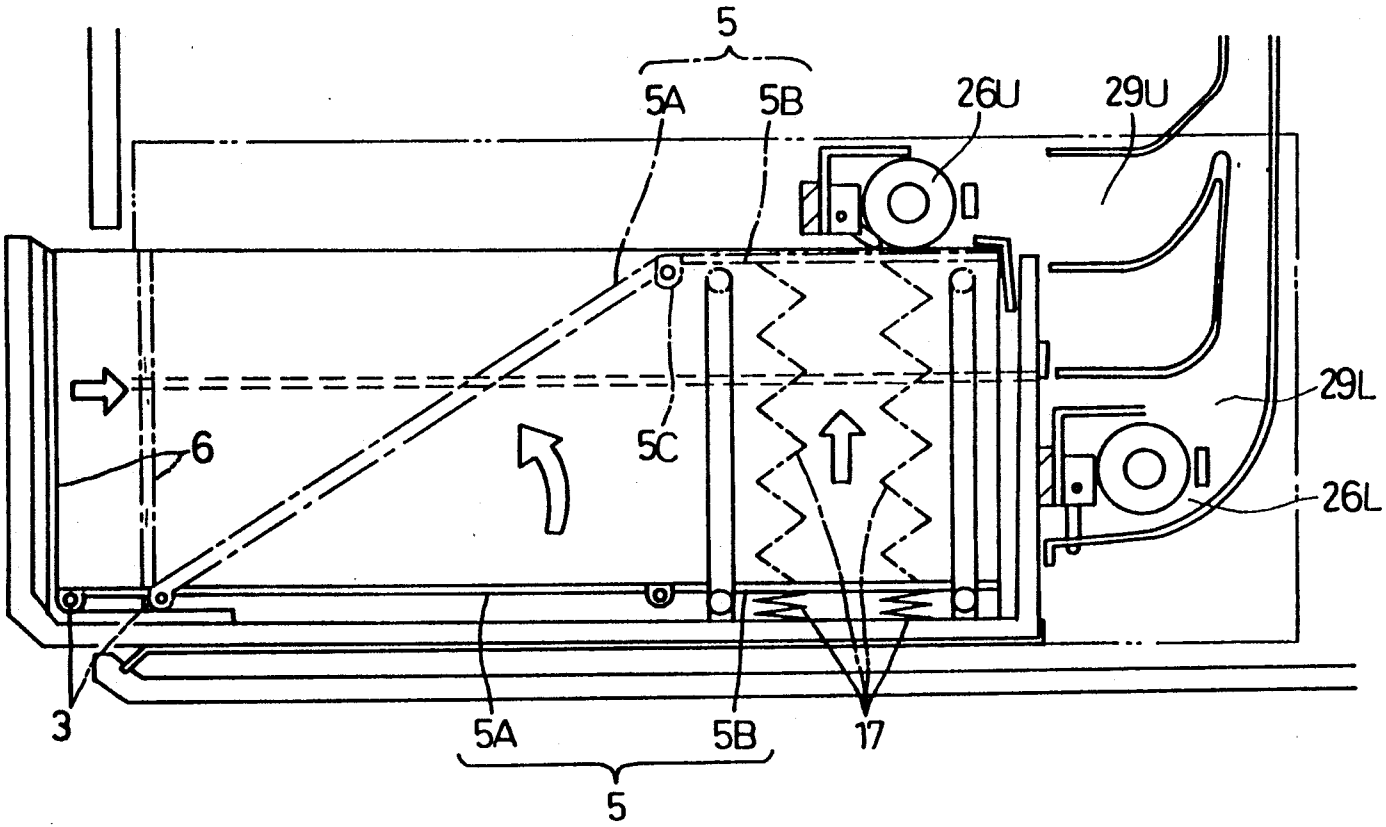
FIG. 5 is a side sectional view showing the sheet supplying device with one large cassette installed therein.

As shown in FIG. 5, a hopper comprising a spring 17 and a bottom board 5 is formed in the lower portion of the large cassette L. The bottom board 5 comprises two boards 5A and 5B connected by a hinge 5C. A link is provided under the bottom board 5B, so that the bottom board 5B is kept horizontal as it rises. An arrangement board 6 for arranging the trailing edges of the sheets is joined by a hinge 3 to the bottom board 5A. Therefore, when the bottom board 5 is displaced (shown by the dashed line in FIG. 5) as the number of sheets held in the cassette decrease and the remaining sheets held therein bend to follow the contour of the boards, the arrangement board 6 moves forward to follow the movement of the bottom board 5A, and the trailing edges of the cut sheets P(A4) are arranged vertically. As a result, both corners of the leading edge of the topmost sheet are maintained in position against their respective separation click 10.

Figure 2:
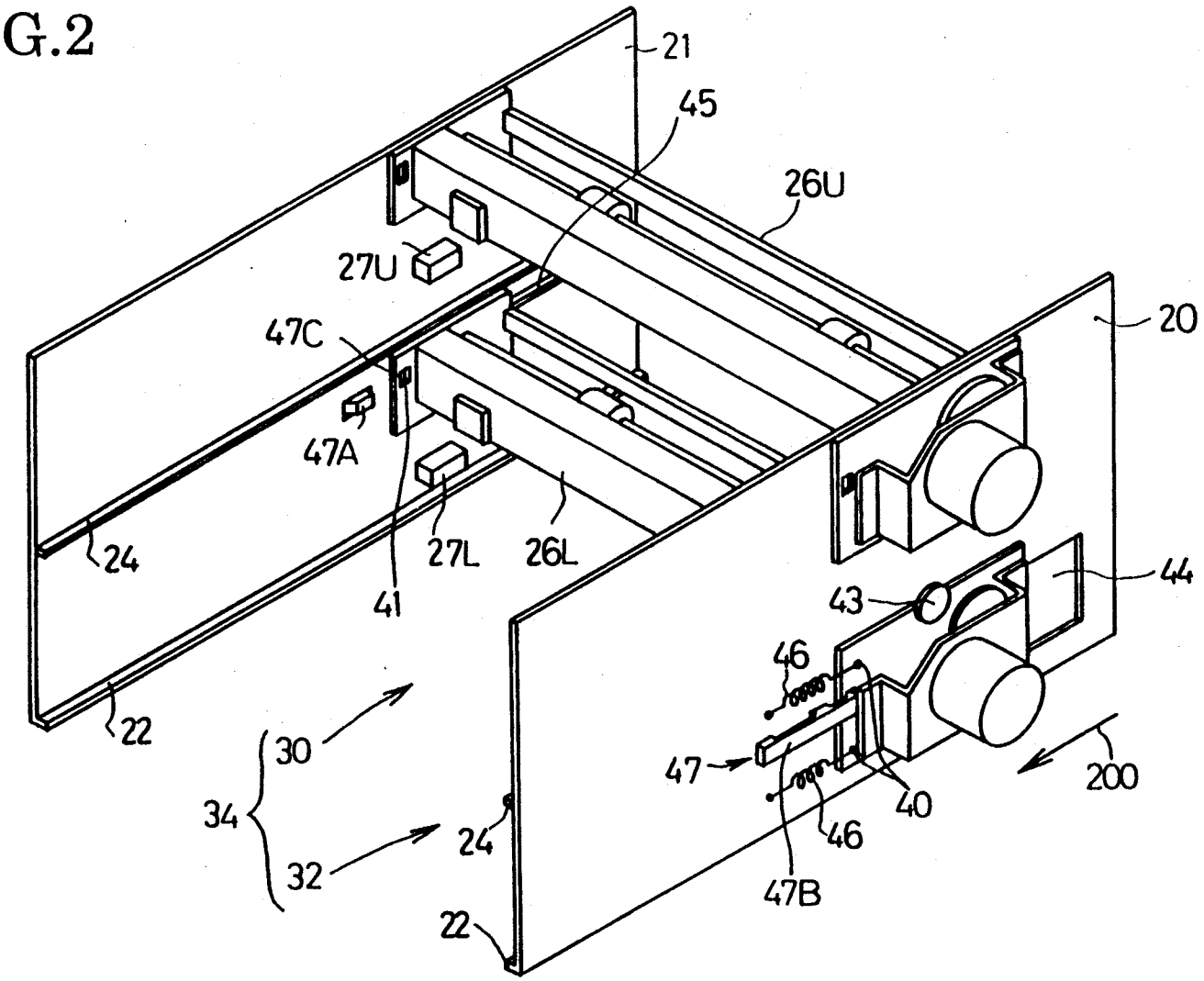
FIG. 2 is a perspective view showing the construction of the sheet supplying device which embodies the present invention.

FIG. 2 is a schematic sectional view of the sheet supplying device showing a cassette installation space 34 formed between a pair of side walls 20,21. A pair of rails 24, 24 is fixed to each of the side walls 20,21, to define an upper space 30 for installing the standard cassette S1 or S2 over a plane connecting the upper surface of the rails 24, and a lower space 32 for installing a second standard cassette S1 or S2 under the plane. The space between rails 24 is wider than the width EL of the lower part of the large cassette L, shown in FIG. 1, so that the large cassette L can be installed in the combined upper and lower spaces. A pair of rails 22,22 is fixed to each of the side walls 20,21 under the combined cassette installation space 34. The rails 22,22 also serve to guide the second standard cassette when installed in the lower space 32. As shown in FIG. 4, a stopper 25 is fixed to each rail 24 for restricting the depth of the insertion of the cassette and a stopper 23 is fixed to each rail 22. Each cassette S1,S2 is inserted, guided by it s side boards 2, 2, front board 8, and guide part 12, 12 along one of the pairs of the rails 22 or 24, until it touches the stopper 23 or 25, respectively.

As shown in FIG. 2, mounted to the side wall 21 defining the cassette installation space are switches 27U, 27L for detecting both the presence of a cassette and identifying the kind of the cassette installed. The switches 27U, 27L are mounted so to be engaged by the projection 14S1, 14S2 or 14L formed on the cassette when the standard cassettes S1, S2 or the large cassette L are inserted until they touch the stoppers 23, 25. The presence of the cassette and the kind of the cassette installed are distinguished based upon the signal output by the switch 27U, 27L.

Moreover, a pair of lock materials 47 for supporting a paper feeding unit 26L in the lower space 32 are installed in the feeding position where a paper supplying roller 35L contacts the topmost cut sheet P stored in the installed standard cassette S1, S2, and feeds the cut sheet P. The pair of lock materials 47 is installed between the upper space 30 and the lower space 32 and outside of the side walls 20,21. The lock materials 47 comprise claw portions 47C for supporting the feeding unit 26L, projections 47A which are pressed to the outside of the side walls 20,21 by the lock release projections 48 fixed on the large cassette L when the large cassette L is inserted, and elastic arm portions 47B fixed on the side walls 20,21 for supporting the claw portions 47C and the projections 47A. The claw portions 47C and the projections 47A project inside of the side walls 20,21 through apertures 41 formed on the side walls 20,21. Springs 46 for returning the feeding unit 26L in the direction indicated by the arrow 200 in FIG. 2 (usual paper supplying position), and pins 40 where one end of the spring 46 is fixed are arranged in the upper and lower side of the lock materials 47.

Further, a guide groove 45 where a feeding unit guide roller 43 described below can be passed is formed in the left side frame 21 in FIG. 2. A paper feeding unit insertion hole 44 where the feeding unit 26L can be retracted is formed in the right side frame 20 in FIG. 2.

Next, the construction of the paper feeding unit 26L will be explained with reference to FIG. 3.

Figure 3:
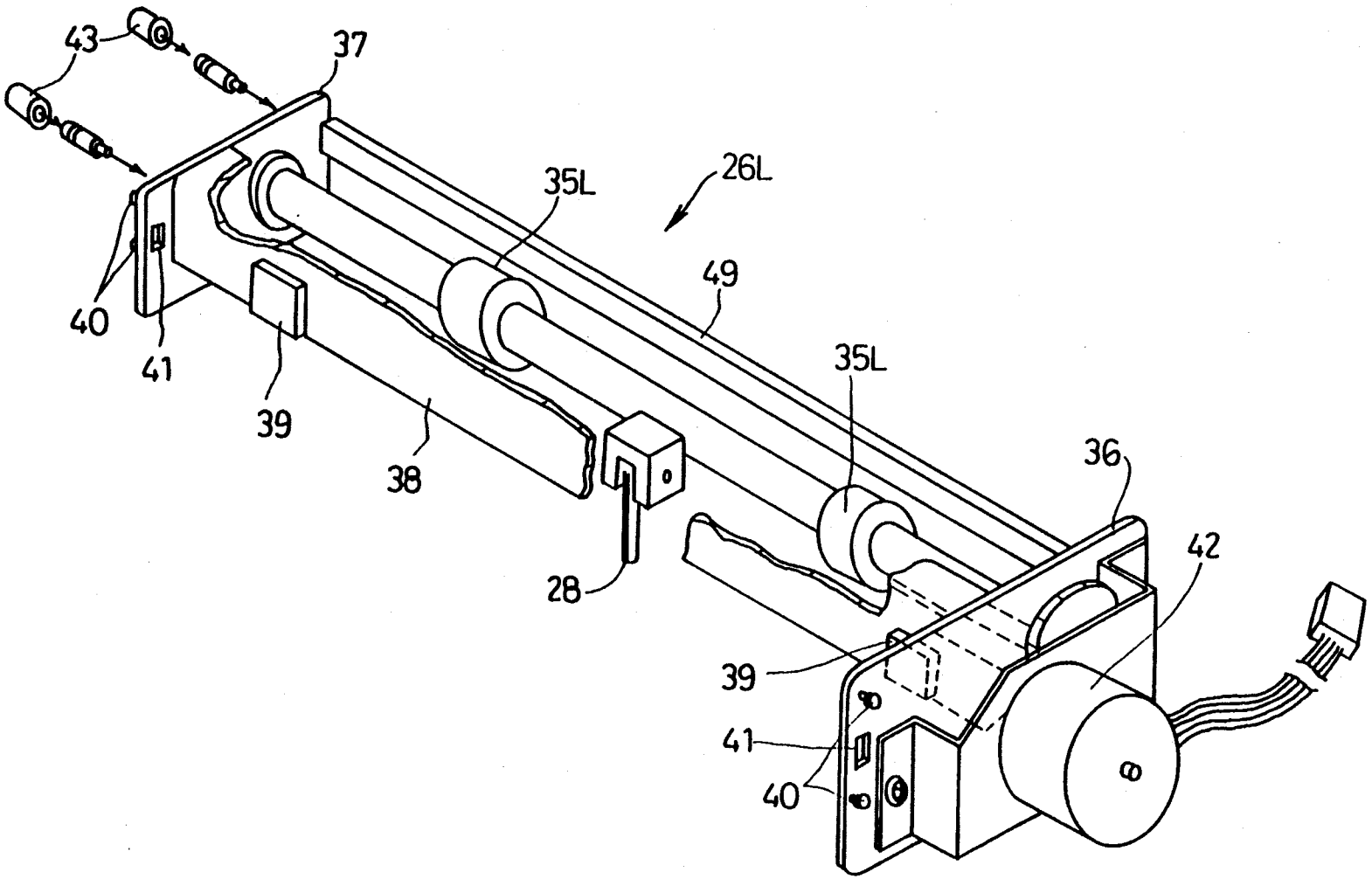
FIG. 3 is a perspective view showing a paper feeding unit which embodies the present invention.

As shown in FIG. 3, in the paper feeding unit 26L of this embodiment, a reinforcement material 49 and a paper feeding unit guard 38 which serve to reinforce the feeding unit 26L are installed between a pair of paper feeding unit side frames 36 and 37. A cushion material 39 is provided in the cassette insertion side of the paper feeding unit guard 38 in order not to damage the large cassette L and in order to lessen the impact to the feeding unit 26L when the front board 8 of the large cassette L comes in contact with the feeding unit 26L.

In the paper feeding unit 26L, the paper supplying roller 35L is rotatably arranged between the side frames 36 and 37. A motor device 42 for selectively driving the paper supplying roller 35L is provided on the side frame 36. Moreover, the feeding unit guide roller 43 is provided on the other side frame 37, the feeding unit guide roller 43 being guided by the above mentioned guide groove 45 to move the feeding unit 26L smoothly on the side frame 21.

A sheet sensor 28 is provided for detecting whether or not the cut sheet P is present in the standard cassette S1, S2 or the large cassette L is arranged on the paper feeding unit guard 38.

The side frame 37 is smaller than the other side frame 36 in order to insert the feeding unit 26L easily from the one side of the paper supplying device, when the feeding unit 26L is installed on the side walls 20,21 of the paper supplying device.

An installation procedure of the feeding unit 26L is as follows. The feeding unit 26L is inserted from the insertion hole 44 of the side wall 20. The guide roller 43 is then inserted in the guide groove 45 on the other side wall 21, and the guide roller 43 is also inserted in the guide groove 45 of the side wall 20. The side frame 36 is then fixed in position. The feeding unit 26L can move lightly along the side walls 20,21 by this installation, but it does not move in the direction of insertion once the side frame 36 is fixed in position. Next, the feeding unit 26L is pulled in the direction indicated by the arrow 200 shown in FIG. 2 by hanging the springs 46 on the pins 40 on the side frames 36,37. The claw portions 47C of the lock materials 47 engage to lock holes 41 formed on the side frames 36,37, and the feeding unit 26L is held in the paper feeding position. In addition, the paper feeding unit support mechanism of the present invention comprises the guide grooves 45 and the guide rollers 43 of the side walls 20,21.

In a paper feeding unit 26U located in the upper space 30, the paper feeding unit side frame 37 thereof does not include the same paper feeding unit guide roller 43 provided in the feeding unit 27L. Other members which comprise the feeding unit 27U are similar to those of the feeding unit 26L, so that the explanation thereof will be omitted. The paper feeding unit 26U is fixed to the side walls 20 and 21.

Next, the paper supplying device in which each of standard cassettes S1 and S2 is installed in the upper space 30 and the lower space 32 is shown in FIG. 4. A paper supplying roller 35U of the paper feeding unit 26U installed on the upper space 30 comes in contact with the topmost cut sheet P accommodated in the standard cassette S1 by being pushed up properly by a spring 17 through a bottom board 19 of the cassette S1. Only the topmost cut sheet P is separated by the separation click 10U when the paper supplying roller 35U rotates. Then, the separated cut sheet P is fed to a printing unit (not shown) through the paper feeding path 29U. The paper feeding from the standard cassette S2 installed in the lower space 32 is similarly performed.

As shown in FIG. 4, the lock material 47, the paper feeding unit guard 38, and the cushion material 39 are arranged in the position where the paper supplying operation from the standard cassettes S1 installed in the upper space 30 and the standard cassette S2 installed in the lower space 32 is not disturbed. Moreover, the lower paper feeding unit 26L is held in the paper feeding position in which the paper supplying roller 35L comes in contact with the topmost cut sheet P in the standard cassette S2 by the lock material 47. The separation and the paper feeding operation by the lower paper feeding unit 26L is similar to that performed by the paper feeding unit 26U.

Next, the paper supplying device where the large cassette L is installed is shown in FIG. 5. When the large cassette L is installed, the paper is fed from the large cassette L by the paper feeding unit 26U. The lower paper feeding unit 26L is retracted in a lower paper feeding path 29L by inserting the large cassette L. In this embodiment, adequate space is fixed as the lower paper feeding path 29L. However, it is possible to retract the paper feeding path itself in synchronism with the retraction of the paper feeding unit 26L.

Figure 6:
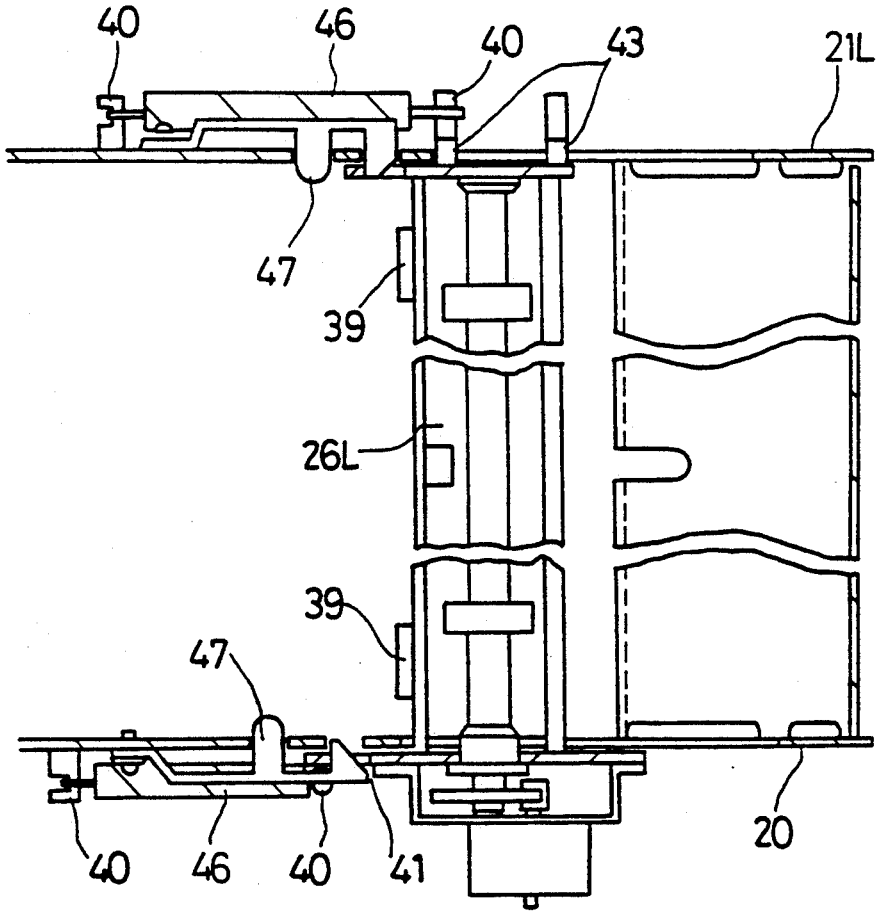
FIG. 6 is a transverse sectional view showing the main body of the sheet supplying device.

The movement of the paper feeding unit 26L by the insertion of the large cassette is explained with reference to FIG. 6 and FIG. 7. FIG. 6 shows the paper supplying device without the large cassette L. The lower paper feeding nit 26L is pulled to the paper feeding position by the spring power of the springs 46. The claw portions 47C of the lock materials 47 engage the lock holes 41 formed on the side frames 36,37, and the feeding unit 26L is held in the paper feeding position.

Figure 7:
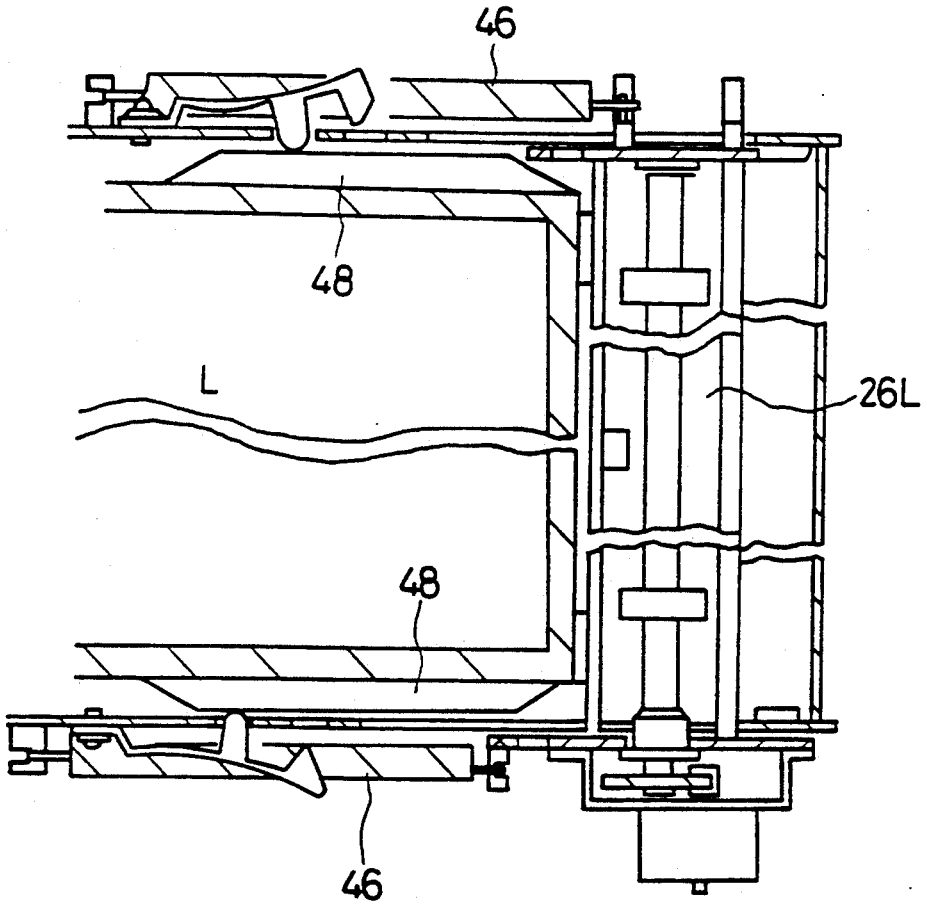
FIG. 7 is a transverse sectional view showing the sheet supplying device with one large cassette installed therein.
Figure 8:
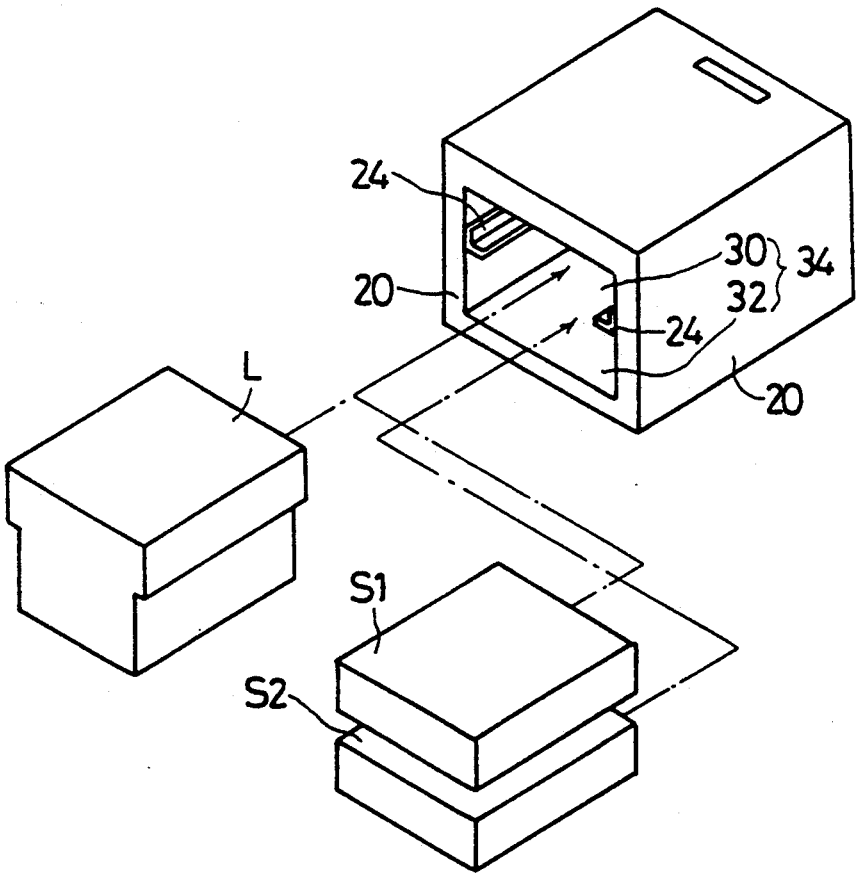
FIG. 8 is a perspective view showing how the cassette may be installed in the present invention.

FIG. 7 shows the paper supplying device with the large cassette L installed. The large cassette L is inserted in the cassette installation space 34 along the rails 24,24. Before the large cassette L comes in contact with the cushion material 39 of the paper feeding unit 26L, the lock release projections 48 which are in the front of both sides of the large cassette L come in contact with the projection 47A of the lock material 47, and extend the lock material 47 to the outside. At this time, the claw portion 47C of the lock material 47 by which the paper feeding unit 26L is held comes off from the lock hole 41 of the paper feeding unit side frames 36 and 37, and the paper feeding unit 26L can move.

When the large cassette L is inserted, the paper feeding unit 26L is pushed through the cushion material 39, the paper feeding unit guide roller 43 is moved along with the guide groove 45 of the side walls 20,21 and retreats to the position where the large cassette L touches the stopper 23. At this position, the large cassette L is held by the cassette lock unit (not shown) and is not moved by the force of the spring 46.

Moreover, when the large cassette L is removed from the paper supplying device, the paper feeding unit 26L is pulled by the spring 46 and returns to the paper feeding position in synchronism with the movement of the large cassette L. Then, the claw portion 47C of the lock material 47 again engages the lock hole 41. The large cassette L is shaped as shown in FIG.1, so that it does not contact the switch 27L and the lower paper feeding unit 26L is not operated, when the large cassette L is inserted in the paper supplying device.

As mentioned above, the user can install standard cassettes S1,S2 as shown in FIG. 4 and can use both cut sheets P of A4 and A3 selectively. Moreover, the user can install the large cassette L easily as shown in FIG. 5 when large quantities of a cut sheet P of a specific size are required. In such a case, larger quantities of cut sheet P can be supplied to the print part than the maximum number of sheets accommodated in two standard cassettes S1,S2 without requiring further replenishing.

While the present invention has been described in the above embodiment as a sheet supplying device where one large cassette L can be used replacing two standard cassettes S1,S2, it is to be understood that the invention may be embodied in a sheet supplying device where one large cassette can be used to replace three or more standard cassettes. Moreover, in the case where three standard cassettes or more can be installed, it is possible to use a large cassette that replaces only the upper and middle standard cassettes or the middle and lower standard cassettes.

Figure 9:
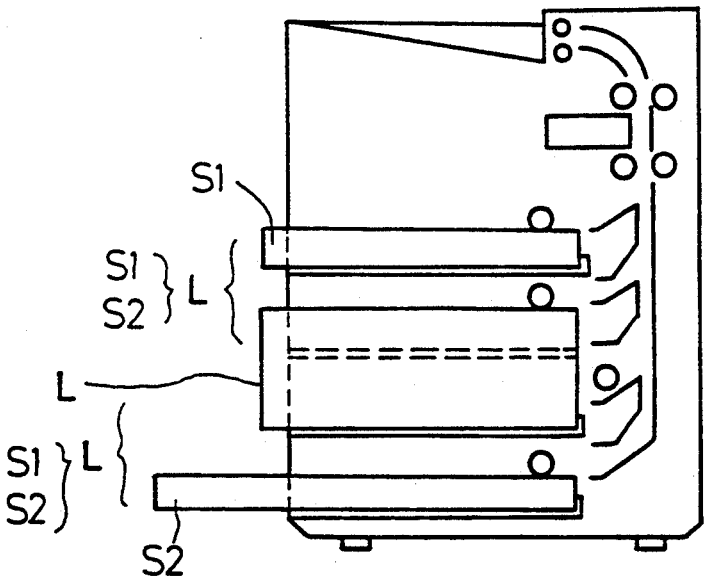
FIG. 9 is a schematic sectional view showing a sheet supplying device in another embodiment of the present invention.
Figure 10A:
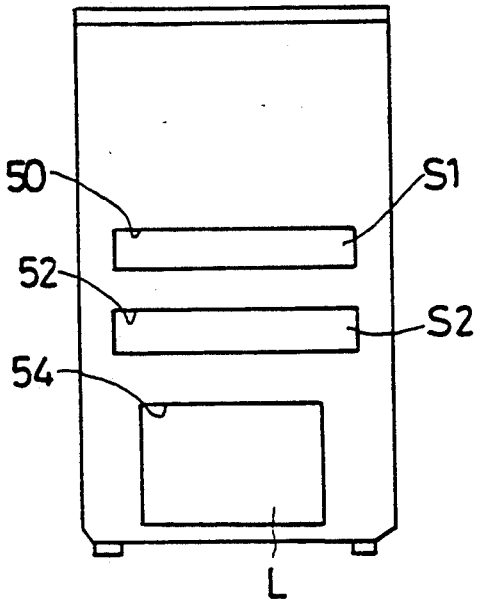
FIG.10A RELATED ART
FIG. 10A is a front view showing a conventional sheet supplying device.
Figure 10B:
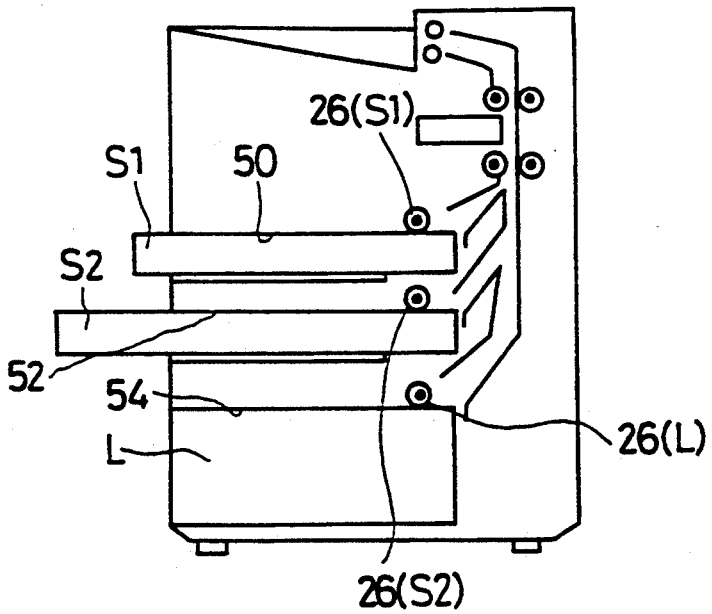
FIG.10B RELATED ART
FIG. 10B is a side sectional view showing the conventional sheet supplying device.
Figure 11:
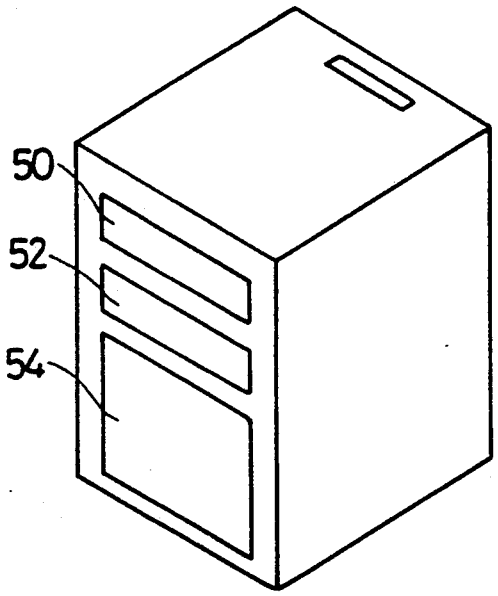
FIG.11 RELATED ART
FIG. 11 is a schematic perspective view showing the conventional sheet supplying device.

Further, as shown in FIG. 9, in a sheet supplying device having a space for four standard cassettes to be installed therein, it is possible to install four standard cassettes, or to install one large cassette and two standard cassettes as shown in FIG. 9, or to install two large cassettes. Or, the users can select the cassette according to the situation of use, for example one super large cassette and one standard cassette, or two large cassettes. Further, if the condition of use changes, the sheet supplying device of the present invention is possible to deal with various situations only by selecting the cassettes without improving and replacing the device.

While this invention has been described in conjunction with specific embodiments thereof, it is evident that many alternatives, variations and modifications will be apparent to those skilled in the art. For instance, in the adsorption separation method, even when the paper feeding unit is moved by the lever operation of the user and the electric signal, a similar effect is obtained. Thus, the varying needs of the user can be realized by the present invention. The preferred embodiments of the invention are intended to be illustrative, not limiting. Various changes may be made without departing from the spirit and scope of the invention as defined in the following claims.

What is claimed is:

1. A cassette type sheet supplying device comprising:

a cassette installation main body having an opening portion to a mounting space for installation of a plurality of cassettes, said mounting space accommodating said cassettes in vertical relationship with respect to one another;

a plurality of standard cassettes for storing cut sheets;

a large cassette for storing cut sheets in an amount larger than that of said standard cassettes, said mounting space alternatively accommodating said large cassette and said plurality of standard cassettes;

a plurality of paper feeding means for extracting a top sheet of said cut sheets from said cassettes, said paper feeding means being provided for each said cassette, said paper feeding means comprising a to paper feeding means and at least one lower paper feeding means;

a retracting means for retracting said lower paper feeding means from a paper feeding position where an operation of extracting a top cut sheet from each said cassette is effected, to a retracted position where said retracted paper feeding means does not obstruct an insertion of said large cassette; and a drive means for driving unretracted paper feeding means to extract said top cut sheet from at least one of said cassettes.

2. The cassette type sheet supplying device as claimed in claim 1, wherein said retracting means has a guide member for guiding and installing said retractable paper feeding means.

3. The cassette type sheet supplying device as claimed in claim 2, wherein said guide member includes a pin and a rail on which said pin slides.

4. The cassette type sheet supplying device as claimed in claim 1, wherein said paper feeding means has a holding member for holding said paper feeding means at a paper feeding position.

5. The cassette type sheet supplying device as claimed in claim 1, wherein said paper feeding means has a returning member for returning the retracted paper feeding means from the retracted position to a paper feeding position.

6. The cassette type sheet supplying device as claimed in claim 5, wherein said returning member includes an urging member.

7. The cassette type sheet supplying device as claimed in claim wherein said large cassette has a release means for releasing said holding means when said large cassette is inserted.

8. The cassette type sheet supplying device as claimed in claim 6, wherein said large cassette moves said paper feeding means to the retracted position, said large cassette providing resistance against the urging force of the urging member when said large cassette is inserted.

9. A cassette type sheet supplying device comprising:

a cassette installation main body having an opening portion to a mounting space for installation of a first standard cassette holding cut sheets and a second standard cassette holding cut sheets whose size may be different from the size of the cut sheets in said first standard cassette;

first and second paper feeding means associated with each of said first and second standard cassettes, respectively, for feeding a cut sheet, said paper feeding means being mounted in said cassette installation main body;

a large cassette for storing cut sheets in an amount larger than that of said first and second standard cassettes, said mounting space accommodating said large cassette in place of both said first and second standard cassettes;

a retracting means for retracting said second paper feeding means associated with said second standard cassette from a paper feeding position where an operation of extracting a top cut sheet from said second standard cassette is effected to a retracted position where said retracted second paper feeding means does not obstruct an insertion of said large cassette; and a drive means for selectively driving said first and second paper feeding means to extract the top cut sheet from unretracted cassettes.

10. The cassette type sheet supplying device as claimed in claim 9, wherein said mounting space includes an upper mounting space for installing said first standard cassette and a lower mounting space provided under said upper mounting space for installing said second standard cassette.

11. The cassette type sheet supplying device as claimed in claim 9, wherein said mounting space is a continuous installation space which is capable of accommodating said large cassette and which is capable of accommodating at least two of said standard cassettes.

12. The cassette type sheet supplying device as claimed in claim 1 wherein said paper feeding means includes a first roller for extracting a cut sheet from a first one of said standard cassettes and a second roller for extracting a cut sheet from a second one of said standard cassettes.

13. The cassette type sheet supplying device as claimed in claim 12, wherein said first roller for said first standard cassette extracts a cut sheet stored in said large cassette when said large cassette is installed in place of both said first and second standard cassettes.

14. The cassette type sheet supplying device as claimed in claim 1, further comprising a first installation detecting means for detecting an installation of a first one of said standard cassettes into said mounting space, and a second installation detecting means for detecting an installation of a second one of said standard cassettes into said mounting space, and wherein said first installation detecting means detects the installation of said large cassette into said mounting space when said large cassette is installed in place of both said first and second standard cassettes.

15. The cassette type sheet supply device as claimed in claim 14, wherein said large cassette includes a body having a step to prevent detection by the second installation detecting means when said large cassette is installed in place of both said first and second standard cassettes.

16. The cassette type sheet supplying device as claimed in claim 1, further comprising a first sheet detecting means for detecting if a cut sheet remains in said first standard cassette and a second sheet detecting means for detecting if a cut sheet remains in said second standard cassette, and wherein said first sheet detecting means detects if a cut sheet remains in said large cassette when said large cassette is installed in place of both said first and second standard cassettes.

17. The cassette type sheet supplying device as claimed in claim 1, further comprising first and second sheet feeding paths communicating with a forward end of first and second ones of said standard cassettes that are remote from said opening portion to said mounting space, and wherein a cut sheet stored in said large cassette is fed through said first sheet feeding path when said large cassette is alternatively accommodated in said mounting space.

18. The cassette type sheet supplying device as claimed in claim 17, wherein said paper feeding means for said second standard cassette is disposed to be retracted in said second sheet feeding path when said large cassette is alternatively accommodated in said mounting space.

19. A cassette type sheet supplying device comprising:

a cassette installation main body having a mounting space for accommodating at least two standard cassettes;

a separate paper feeding means associated with each of the at least two standard cassettes, said paper feeding means being mounted in said cassette installation main body;

a large cassette capable of being accommodated in said mounting space in place of the at least two standard cassettes, wherein said paper feeding means associated with one of said at least two standard cassettes is capable of feeding paper from said large cassette, the paper feeding means for all other replaced standard cassettes being movable to establish the space accommodating the large cassette.

* * * * *